United States Patent [19]

Yang

[11] Patent Number: 4,755,161

[45] Date of Patent: Jul. 5, 1988

[54] TOY WITH PREDETERMINED CONTROLLED STEERING

[76] Inventor: Tai-Cheng Yang, 14, Lane 616, Cheng-Teh Rd., Taipei, Taiwan

[21] Appl. No.: 898,363

[22] Filed: Aug. 20, 1986

[51] Int. Cl.[4] ..... A63H 17/395

[52] U.S. Cl. ..... 446/436; 446/460; 180/79

[58] Field of Search ..... 446/437, 436, 460, 468; 180/79.1, 79; 56/10.2, DIG. 15

[56] References Cited

U.S. PATENT DOCUMENTS

| | | | |
|---|---|---|---|
| 2,146,708 | 2/1939 | Barrett | 446/436 |
| 3,061,035 | 10/1962 | King | 180/79.1 |
| 3,717,952 | 2/1972 | Strongin | 446/436 |
| 4,165,581 | 8/1979 | Wolf | 446/175 |

*Primary Examiner*—Mickey Yu

*Attorney, Agent, or Firm*—Browdy and Neimark

[57] ABSTRACT

A toy vehicle having a toy body, with a motor geared down to drive the rear wheels, and a geared annular hub with adjustable multi-directional adjustment devices mounted on the periphery of the geared annular hub, with projections which contact either an upper rod or a lower rod, or neither, during rotation of the annular hub, causing front heels of the toy to turn to the left, right or maintain straight travel respectively. After the upper or lower rod pivots to move a respective spring connected other upper or lower rod respectively, the front wheels are deflected to the left or right in travel, and tension springs fixed between a forward shifting transverse rod and the toy body immediately pull the front wheel turn mechanism back to its original position for continuance of straight line travel.

8 Claims, 2 Drawing Sheets

TOY WITH PREDETERMINED CONTROLLED STEERING

FIELD OF THE INVENTION

The present invention relates to toy vehicles, in particular, to the transmission and steering mechanism that can make the toy vehicles travel in a zigzag path with a wide variety of changes and also keep to a sequence set up by the user.

BACKGROUND OF THE INVENTION

Presently, most simple toys commonly, when their power supply switch is turned on, will repeat actions in an identical simple way, so that the players often become bored if they play with these toys for a long time. Besides, simple toy vehicles can only travel in a straight line or loop and will move back whenever they confront any obstacles. Therefore, they can be monotonous to the players and can hardly stimulate most children's interests.

OBJECTS OF THE INVENTION

The primary object of the present invention is to solve the defects of the transmission and steering structure of conventional toys and to provide a novel transmission and steering structure for toy vehicles, thereby making a toy vehicle conduct itself along a zigzag path in a preset sequence, set by the user, so its travel route is totally within the user's concept.

Another object of the present invention lies in that the mechanism controlling the vehicle's travel direction can be adjusted to make and achieve different travel routes, thereby invigorating the children's intelligence and triggering their ingenuity and creativity.

SUMMARY OF THE INVENTION

A transmission and steering structure for toy vehicles mainly using a motor to drive the wheels to make the vehicle body move forward by a reduction gear train, while a worm gear in the middle portion of the drive wheel shaft also drives a geared annular hub in rotation, with direction adjustment devices provided on the annular hub hitting against rods of a pivoting parts set to deflect the rods which transmit through the wheel turn mechanism to turn the toy vehicle aside to the right or left in its travel, tension springs fixed between the forward displacement transverse rod and the toy body immediately pulling the wheel turn mechanism back to its original position for a return to straight line travel.

A toy vehicle with a travel route which has a great variety of changes so that the toy vehicle transmission and steering mechanism can be pre-set by a user's preconceived concept and can also travel in a path according to the user's desire.

DETAILED DESCRIPTION OF A PREFERRED EMBODIMENT

Figure 1:
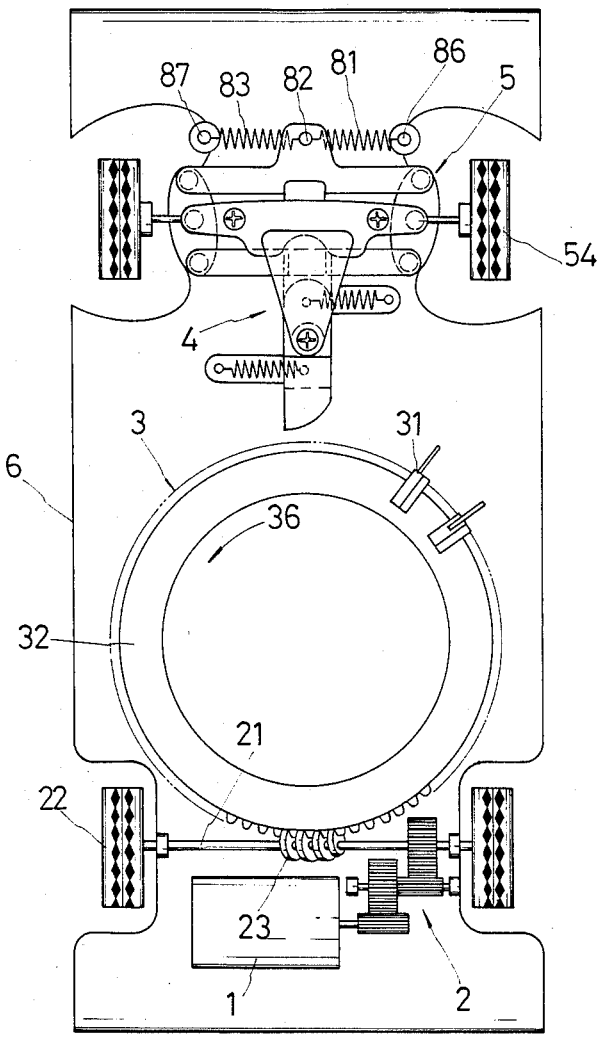
FIG. 1 is a top view of an exemplary embodiment of the present invention.

As shown in FIG. 1, the present invention is composed of a drive motor 1, a gear train 2, a geared annular hub 3, a pivoting parts set 4, a front wheel turning mechanism 5 and a toy body 6; of which motor 1 rotates gear train 2, and after thus reducing R.P.M., gear train 2 drives rear wheel shaft 21. Toy body 6 is driven by rear wheel 22 to produce forward motion of toy body 6. In the middle portion of rear wheel shaft 21 is worm gear 23 which engages geared annular hub 3.

Figure 2:
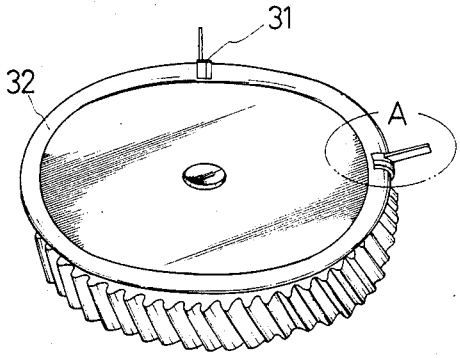
FIG. 2 is a perspective view of the geared annular hub with multi-direction adjustment devices of the present invention affixed thereto.
Figure 3:
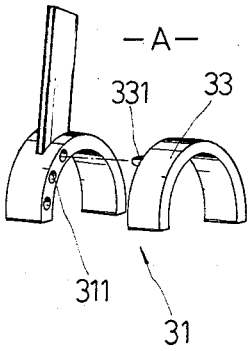
FIG. 3 is an enlarged perspective view of an adjustment device shown in Circle A, in FIG. 2.

As shown in FIGS. 2, 3, geared annular hub 3 is pivoted in toy body 6. A multi-direction adjustment device 31 is applied to a peripheral belt 32 on annular hub 3. The multi-direction adjustment device 31 consists of sleeve direction adjustment rods each clamped to annular hub belt 32, and a direction fixing seat 33 mated at its side. The direction fixing seat 33 is fixed on the perimeter of annular hub belt 32 and has a convex point 331 protruding from its side to mate in the positioning hole 311 in the side of the adjacent seat of the sleeve direction adjustment rod. Therefore, multi-direction adjustment device 31 is mated to direction fixing seat 33 and can be adjusted to three different positions such as upward 45° relative to the horizontal plane, level, or aiming a downward 45° relative to the horizontal plane, in anyone of those pre-set angular positions.

Figure 4:
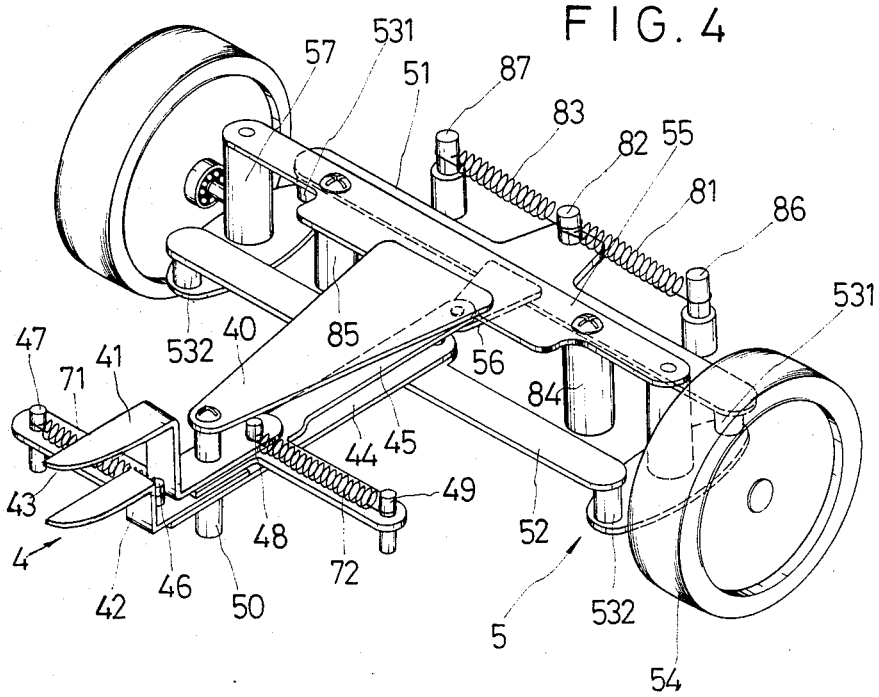
FIG. 4 is an enlarged perspective view of the pivoting parts set and front wheel turn mechanism of the present invention.

As shown in FIG. 4, the pivoting parts set 4 is composed of an upper rod 41, lower rod 42, an extension 43, which is a part of a lower straight rod 44, an extension plate 40, an upper straight rod 45, four pins 46, 47, 48, 49 and two tension springs 71, 72, each of the upper straight rod 45 and the lower straight rod 44 having spring 71, 72 respectively to control a buffering action of upper and lower rods 41, 42. Upper and lower rods 41, 42 are respectively lapped to upper straight rod 45 and the lower straight rod 44, and a shaft 50 supports them on toy body 6. One side end of lower straight rod 44 has an extension 43 which is integrated with lower straight rod 44. Lower rod 42 and extension 43 respectively have pins 46, 47. There is an extension spring 71 between these two pins 46, 47 to hook them to each other. Besides, the upper rod 41 and the upper straight rod 45 respectively have pins 48, 49, with another tension spring between pins 48, 49 to hook them up together. The front wheel turning mechanism 5 is composed of a front shifting transverse rod 51, a rear shifting transverse rod 52, a front shifting device 531 and a rear shifting device 532, and a shaft fixing rod 55; of which both sides of the front shifting transverse rod 51 are pivoted on a pin to each of the front shifting devices 531. In the middle of the forward part of the front shifting transverse rod 51, on a flange extending forward, pin 82 and the two posts 86, 87 are connected by two tension springs 81, 83 to hook posts 86, 87 to pin 82. Also, a triangular plate 56 which is rigidly attached to the middle portion of front shifting transverse rod 51 is pivotally connected to upper straight rod 45. Both sides of the rear shifting transverse rod 52 are pivoted by pins to shifting devices 532. The lower straight rod 44 is pivotally connected by a pin to the middle of rear shifting transverse rod 52. Both sides of wheel shaft fixing rod 55 are pivotally connected to rotary shafts 57 mounted on plates upon which the shifting devices 531 and 532 are also pivotally mounted. The middle part of wheel shaft fixing rod 55 is attached by fasteners to shaft rods 84, 85 for firmly fixing onto body 6. An extension plate 40 is provided which is pivoted by a fastener on its rear end to the shaft 50.

In the present invention, there are only two rods 41, 42, the upper rod 41 and the lower rod 42, and the multi-direction adjustment device has three positions for shifting. In other words, one of the positions for adjustment of the multi-direction adjustment device is so as it cannot touch either upper or lower rods 41, 42 and the vehicle can maintain travel in a straight line.

The operation of the present invention is as follows. When geared annular hub 3 rotates in a direction as indicated by the arrow 36 (as shown in FIG. 1), and multi-direction adjustment devices 31 provided on annular hub belt 32 of geared annular hub 3 touch upper rod 41, as each device 31 passes, the front shifting transverse rod 51 rotates toward the left, the rear shifting transverse rod 52 rotates toward the right, i.e. the front wheels 54 turn aside to the left; and in a reverse manner, when the post or projecting part on each multi-direction adjustment device 31 touches the lower rod 42, then, via the lower straight rod 44, the rear shifting straight rod 52 rotates toward the left, the front shifting straight rod 51 rotating toward the right, i.e. the front wheels 54 turn aside to the right. When multi-direction adjustment device 31 remains in a horizontal position, it does not touch the upper and lower rods 41, 42. After the above said front wheel shift to the right or left, it is immediately pulled back to its original position by the tension springs 81, 83, thereby maintaining an unshifted (i.e. straight travel) direction to move forward. Each device 31 of a plurality of such devices on annular hub belt 32 can be differently adjusted to provide a variety of turns for a predetermined path of the toy.

Summing up the above, the direction adjustment device 31 of the present invention which is sleeved on the annular hub 3 can be freely adjusted from time-to-time to make the travel loci of the front wheels 54 have a wide variety of changes. In terms of more detail, the users of the present invention can actually adjust the direction adjustment devices 31 to make possible changes of the travel path as they desire whereby it is quite interesting and can stimulate the children's ingenuity and is indeed a rich-educational toy for children.

I claim:

1. A transmission and steering mechanism for a toy vehicle comprising a toy body;

a drive means mounted on said body and including a motor, a gear reduction train connected to said motor, a worm gear mounted on a wheel shaft with said wheel shaft driven in rotation by said gear reduction train;

a geared annular hub rotated by said drive means and having gear teeth at its periphery contacting said worm gear;

at least one adjustment device adjustably fixed on said geared annular hub;

a set of pivoting parts positioned for contact by said at least one adjustment device;

a wheel turning mechanism connected to said set of pivoting parts to be turned toward the left or right of an original position of a longitudinal axis of the toy vehicle by said set of pivoting parts; and spring mechanism to return said wheel turning mechanism back to its original position.

2. A transmission and steering mechanism for a toy vehicle comprising a toy body;

a drive means mounted on said body;

a geared annular hub rotated by said drive means;

at least one adjustment device adjustably fixed on said geared annular hub;

a set of pivoting parts positioned for contact by said at least one adjustment device;

a wheel turning mechanism connected to said set of pivoting parts to be turned toward the left or right of an original position of a longitudinal axis of the toy vehicle by said set of pivoting parts; and spring mechanism to return said wheel turning mechanism back to its original position; wherein said drive means includes a motor, a gear reduction train connected to said motor, a worm gear mounted on a wheel shaft with said wheel shaft driven in rotation by said gear reduction train;

said geared annular hub having gear teeth at its periphery contacting with worm gear; wherein said at least one adjustment device includes a projecting part, said projecting part is adjustable between three positions, 45 degrees up from the horizontal, along the horizontal plane, and 45 degrees down from the horizontal.

3. A transmission and steering mechanism for a toy vehicle comprising a toy body;

a drive means mounted on said body;

a geared annular hub rotated by said drive means;

at least one adjustment device adjustably fixed on said geared annular hub;

a set of pivoting parts positioned for contact by said at least one adjustment device;

a wheel turning mechanism connected to said set of pivoting parts to be turned toward the left or right of an original position of a longitudinal axis of the toy vehicle by said set of pivoting parts; and spring mechanism to return said wheel turning mechanism back to its original position; wherein said at least one adjustment device indludes a direction fixing piece on said geared annular hub, a projecting part attached on said geared annular hub adjacent said direction fixing piece, said projecting part adjustable rotatably relative to said direction fixing piece; wherein said direction fixing piece and said projecting part, one having a sideward projecting convex point and the other having at least three positioning holes on its side positioned to receive said projecting convex point.

4. A transmission and steering mechanism for a toy vehicle comprising a toy body;

a drive means mounted on said body; a geared annular hub rotated by said drive means;

at least one adjustment device adjustably fixed on said geared annular hub;

a set of pivoting parts positioned for contact by said at least one adjustment device;

a wheel turning mechanism connected to said set of pivoting parts to be turned toward the left or right of an original position for a longitudinal axis of the toy vehicle by said set of pivoting parts; and spring mechanism to return said wheel turning mechanism back to its original position; wherein said at least one adjustment device includes
a direction fixing piece on said geared annular hub,
a projecting part attached on said geared annular hub adjacent said direction fixing piece,
said projecting part adjustable rotatably relative to said direction fixing piece; wherein
said set of pivoting parts includes
a shaft supported on said toy body,
an upper rod and a lower rod both having ends extending into the path of said projecting path and pivotal on said shaft,
an upper straight rod and a lower straight rod both pivotal on said shaft,
said upper rod connected by a first spring to said upper straight rod,
said lower rod connected by a second spring to said lower straight rod.

5. The transmission and steering mechanism of claim 4 wherein
said first spring is connected to said upper rod on the side of said upper rod on the side of said shaft away from said end extending into the path for contacting said projecting part,
said second spring is connected to said lower rod on the side of said lower rod on the side of said shaft with said end extending into the path for contacting said projecting part.

6. The transmission and steering mechanism of claim 4 wherein
said wheel turning mechanism includes
a first shifting transverse rod on one side of an axis extending between centers of opposite placed wheels,
a second shifting transverse rod on an opposite side of said axis,
said upper straight rod pivotally connected to said first shifting transverse rod;
said lower straight rod pivotally connected to said second shifting transverse rod.

7. The transmission and steering mechanism of claim 6 wherein
a pair of said wheels is located at the front of said toy body;
said wheel turning mechanism being located on said pair of said wheels;
said first shifting transverse rod located forward of said second shifting transverse rod.

8. The transmission and steering mechanism of claim 6 wherein
said first shifting transverse rod has an extended portion with a spring connected to the left of said extended portion and a spring connected to the right of said extended portion to return said wheel turning mechanism to cause the toy vehicle to move in a straight ahead path.

* * * * *